US012416471B2

(12) United States Patent
Schuda

(10) Patent No.: US 12,416,471 B2
(45) Date of Patent: Sep. 16, 2025

(54) MODULAR HOLSTER ASSEMBLY

(71) Applicant: Douglas Schuda, Westerville, OH (US)

(72) Inventor: Douglas Schuda, Westerville, OH (US)

( * ) Notice: Subject to any disclaimer, the term of this patent is extended or adjusted under 35 U.S.C. 154(b) by 569 days.

(21) Appl. No.: 17/815,676

(22) Filed: Jul. 28, 2022

(65) Prior Publication Data

US 2023/0108400 A1 Apr. 6, 2023

Related U.S. Application Data

(60) Provisional application No. 63/262,047, filed on Oct. 4, 2021.

(51) Int. Cl.
*F41C 33/04* (2006.01)

(52) U.S. Cl.
CPC ..... *F41C 33/041* (2013.01)

(58) Field of Classification Search
CPC .... F41C 33/045; F41C 33/041; F41C 33/043; A45F 5/02; A45F 2005/026; A45F 5/021; A45F 2005/025
USPC ..... 224/197–200
See application file for complete search history.

(56) References Cited

U.S. PATENT DOCUMENTS 6,206,257 B1 * 3/2001 Peele ..... A45F 5/021 224/272
8,517,234 B2 * 8/2013 Kincaid ..... F41C 33/045 224/198
9,301,595 B2 4/2016 Tedder et al.
9,366,383 B2 * 6/2016 Chien ..... F16M 11/16
9,696,113 B2 7/2017 Tedder et al.
10,119,783 B2 11/2018 Tedder et al.
10,274,284 B2 4/2019 Tedder et al.
10,274,296 B2 4/2019 Tedder et al.
10,712,127 B2 * 7/2020 Tedder ..... A45F 5/021
10,883,795 B2 * 1/2021 Rogers ..... F41C 33/043
11,035,648 B2 * 6/2021 Zhang ..... F42B 39/02
11,439,210 B2 * 9/2022 Darby ..... A45C 13/18
2007/0023468 A1 * 2/2007 Ford ..... F41C 33/045 224/198
2015/0323285 A1 * 11/2015 McKendrick ..... F41C 33/045 224/198
2016/0216065 A1 7/2016 Tedder et al.

* cited by examiner

*Primary Examiner* — Corey N Skurdal
(74) *Attorney, Agent, or Firm* — Vorys, Sater, Seymour and Pease LLP; Rex W. Miller, II

(57) ABSTRACT

In an example, a mounting apparatus for releasably connecting a holster can include at least one clip and a canal. The canal can include a grooved path that can extend along a base of the canal, and an inner channel that can receive a plunger of a plunger device to secure the holster to mounting apparatus. The mounting apparatus can include a sliding pusher that can disengage the holster from the mounting apparatus. In some examples, a system can include a holster that can include a ring support structure having a cavity that can include a ring attachment structure. A mounting apparatus of the system can include a cavity that includes the slide lock, and an opening. The mounting apparatus further comprising openings through which portions of pinch plates can extend for disengaging the holster from the mounting apparatus.

5 Claims, 13 Drawing Sheets

MODULAR HOLSTER ASSEMBLY

CROSS-REFERENCE TO RELATED APPLICATION

This application claims priority to U.S. Provisional Application No. 63/262,047, filed Oct. 4, 2021, and entitled "MODULAR HOLSTER," the subject matter of which is incorporated herein by reference in its entirety.

TECHNICAL FIELD

The present disclosure relates to holsters for tools, and more specifically, for firearms.

BACKGROUND

A holster is a device used to hold or restrict an undesired movement of a firearm (e.g., a handgun), most commonly in a location where the firearm can be easily withdrawn for use. Holsters are often attached to a belt or waistband, but holsters may be attached to other locations of a body, or at a readily accessible area. Holsters vary in the degree to which such devices secure and/or protect the firearm. For example, law enforcement holsters have a strap over a top of the holster to make the firearm less likely to fall out of the holster and/or harder for another person to retrieve the firearm. Some holsters have a flap over the top to protect the handgun from the elements.

SUMMARY

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

In an example, a mounting apparatus for releasably connecting a holster can include at least one clip and a canal. The canal can include a grooved path that can extend along a base of the canal, and an inner channel that can receive a plunger of a plunger device to secure the holster to mounting apparatus. The mounting apparatus can include a sliding pusher that can disengage the holster from the mounting apparatus.

In another example, a holster system can include a holster for supporting a tool, and a securing apparatus fixed to the holster. The securing apparatus can include a gear and a plunger device. The plunger device can include a plunger. The plunger device can be positioned at least partially through the gear so that the plunger extends away from the gear. The system can further include a mounting apparatus that can include a clip and a canal. The canal can include a grooved path that can extend along a base of the canal, and an inner channel that can receive the plunger to secure the holster to mounting apparatus. The grooved path can gradually narrows toward the inner channel from an opening to the canal.

In an even further example, a holster system can include a clip, and holster for supporting a tool. The holster can include a ring support structure that can have a cavity that can include a ring attachment structure. The ring attachment structure can include retention portions for engaging a gear head of a slide lock. The holster system can further include a mounting apparatus that can include a cavity that includes the slide lock, and an opening through which the gear head of the slide lock can protrude. The mounting apparatus can further include openings through which portions of pinch plates can extend for disengaging the holster from the mounting apparatus.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to one of ordinary skill in the art and having the benefit of this disclosure.

DETAILED DESCRIPTION

Figure 1:
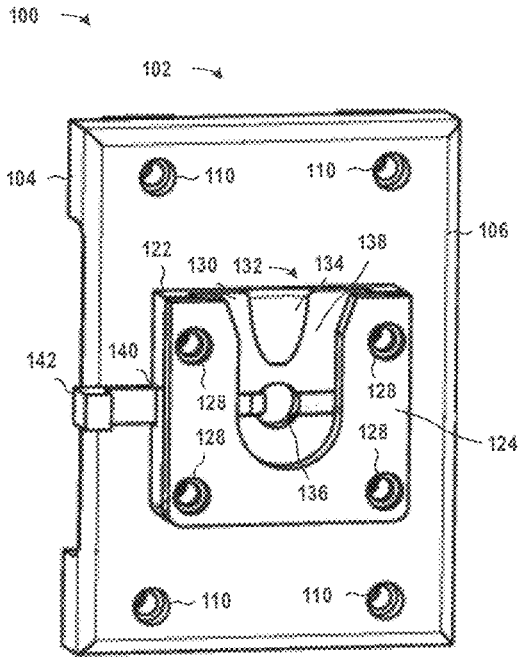
FIG. 1 is a first perspective view of an example mounting apparatus.

Examples of the present disclosure will now be described in detail with reference to the accompanying figures. Like elements in the various figures may be denoted by similar reference numerals for consistency. Further, in the following detailed description of embodiments of the present disclosure, numerous specific details are set forth in order to provide a more thorough understanding of the claimed subject matter. However, the embodiments disclosed herein may be practiced without these specific details. Additionally, it will be apparent that the scale of the elements presented in the accompanying figures may vary without departing from the scope of the present disclosure. Shapes and/or dimensions shown in the figures are for example, and other shapes and/or dimensions may be used and remain within the scope of the present disclosure, unless specified otherwise.

Generally, holsters are designed for particular models of firearms or other holstered firearms, resulting in different holsters for each firearm. Moreover, because of features such as retention mechanisms or simply because of the design of the firearm, holster bodies are commonly not interchangeable for left- and right-handed users. Thus, a user of several firearms that desires to holster them, must purchase and situate on a belt or waistband multiple different holsters, making the process costly, time consuming, and inconvenient.

According to the examples herein, a modular holster assembly is provided that includes a mounting apparatus and a securing apparatus. The modular holster assembly can be used to permit a user to readily and easily interchange holsters for different types of tools and situate the holsters on the user. For example, a first holster for a first tool can be adapted to support a first securing apparatus, and a second holster for a second tool can be adapted to support a second securing apparatus. The mounting apparatus can be worn by the user by securing the mounting apparatus to a belt of the user. The first securing apparatus can engage the mounting apparatus to secure the first holster to the mounting apparatus. In some examples, second securing apparatus can engage the mounting apparatus to secure the second holster to the mounting apparatus. Accordingly, the modular holster assembly according to the examples herein allows for the user to have access to different types of tools by swapping corresponding tool holsters configured with a respective securing apparatus, as described herein.

In some examples, a holster is a sleeve and can support different type of tools. The sleeve can be configured to support a securing apparatus such as described herein. The securing apparatus can be configured to engage a mounting apparatus secured to a belt of user to fix the sleeve to mounting apparatus. Because the sleeve can support different types of tools, the user can swap out tools while retaining a same holster for the tools. Accordingly, the modular holster assembly as described herein can enable the user to use a single sleeve for different tools thus reducing a need for the user to wear different holsters for different tools. The securing apparatus of the modular holster assembly can be applied to any sleeve size, allowing the user to carry tools of any size. Any user who wishes to purchase a holster for an additional tool need only purchase an additional sleeve if they already have the modular holster assembly, resulting in a lower total cost for owners of two or more tools.

Moreover, the modular holster assembly can improve a comfort, and utility, and accommodate different user preferences. The modular holster assembly allows for the user to rotate the tool, for example, to a desired angle. The modular holster assembly enables the user to lock a tool at any angle based on the user's preference for carrying and drawing the tool. If a user has additional sleeves/holsters for additional tools, it will also allow for the same feel and sensation for any tool when it comes to application, removal, and drawing the tool. If a user already has multiple sleeves, it makes swapping tools easier, as the modular holster assembly does not need to be removed by the user. Additionally, the modular holster assembly enables the user to mount tools in other areas, such as a car or a cabinet, and allows the user to store a tool or transfer the tool without requiring the tool to be removed from the sleeve. The modular holster assembly can also be adapted for other carrying areas, in addition to waist/belt carrying.

Accordingly, the modular holster assembly as described herein enables users of multiple sizes of tools to swap one tool for another quickly and easily, without sacrificing a feel and placement. This allows a user to transition from a full-sized firearm to a compact, a semiautomatic to a revolver, or simply an on-duty caliber to a different caliber for personal carry after a work shift, and all in a more cost- and time-efficient manner than owning and changing entire holsters. As such, the modular holster assembly allows for an easy, efficient, and cost-effective manner of changing firearms for open and concealed carry.

The term "tool" as used herein can include a firearm, a knife, a flashlight, or any object that can extend an individual's or users ability to modify features of a surrounding environment. The term "holster" and its derivatives as used herein can include any sleeve, device and/or apparatus that can be used to hold and/or restrict a movement of a tool. While examples are presented herein wherein the holster is situated on a user, in other examples, the holster may be situated on an object (e.g., under a steering column).

Figure 2:
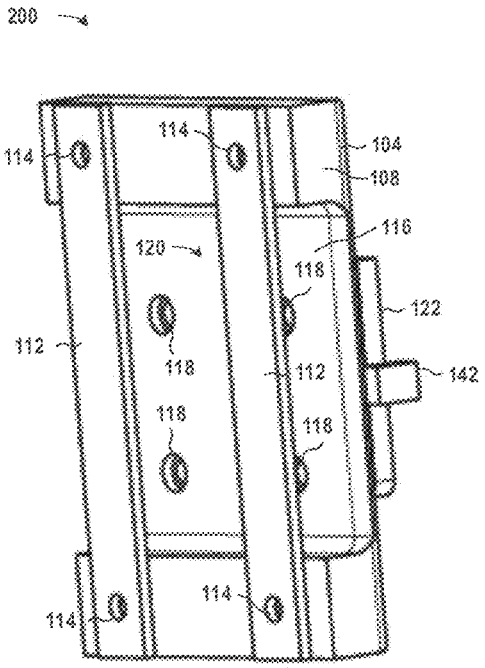
FIG. 2 is a second perspective view of the example mounting apparatus.

FIGS. 1-2 are first and second perspective views 100 and 200 of an example mounting apparatus 102. The mounting apparatus 102 includes a mount 104 having sides 106 and 108. The mount 104 includes a number of channels 110 that extend through the mount 104 and open into the sides 106 and 108 to form respective openings. The mounting apparatus 102 can further include clips 112 that extend along a length of the side 108. While the example of FIG. 2 illustrates two (2) clips in other examples, a single loop can be used, and positioned along a center length of the side 108. In some examples, the mount 104 and the clips 112 are composed of different or similar materials. As an example, the materials may include flexible and/or durable materials. In additional or alternative examples, the mount 104 and the clips 112 can be composed of a plastic material (e.g., a thermoplastic material) or metal material. The clips 112 can be used to mount or secure the mounting apparatus 102 to a user (e.g., via a garment, belt, strap, or accessory), or an object (e.g., a surface, furniture, vehicle, locker, etc.).

By way of further example, channels 114 can extend through the clips 112 to respective loop sides to form respective openings. The openings of the clips 112 can be aligned with one of the respective openings of the mount 104 and secured via a fastener (e.g., a screw, a bolt, etc.) to fix the clips 112 to the mount 104 to form respective loops (e.g., for receiving a belt to secure the mounting apparatus 102 to the user). In other examples, a different mechanism can be used to secure the clips 112 to the mount 104. For example, the clips 112 can be welded to the mount 104 (e.g., using a welding material).

The mount 104 further includes a recess 116 on the side 108. Channels 118 can extend through the mount 104 to the sides 106 and 108 to form respective openings. The securing of the clips 112 to the mount 104 can form a passageway(s) or loop(s) 120. In some examples, to secure the mount 104 to a user, a belt of the user can be threaded along a width of the mount 104 through the loop 120. In further examples, the mount 104 includes a base plate 122 and a base plate cover 124. Channels 128 can extend through the base plate 122 and the base plate cover 124 to form respective openings. The respective openings of the base plate 122 can be aligned with one of the respective openings of the channels 118 on the side 106 and secured via a fastener (not shown) to fix the base plate 122 to the mount 104. In other examples, a different mechanism can be used to secure the base plate 122 to the mount 104 such as described herein.

In some example, the base plate 122 can be at least partially hollow to form or support a canal 130 with an opening 132. As described herein, a securing apparatus on a sleeve can be positioned in the canal 130 to secure the sleeve to the mount 104. For example, the canal 130 can include a grooved path 134. The grooved path 134 can extend along a base 138 of the canal 130 from the opening 132 toward an inner channel 136 that opens to the canal 130. In some examples, the base plate 122 can include a side opening 140 through which a sliding pusher 142 can be positioned. The sliding pusher 142 can extend partially through the side opening 140 toward the inner channel 136, as shown in FIG. 1.

Figure 4:
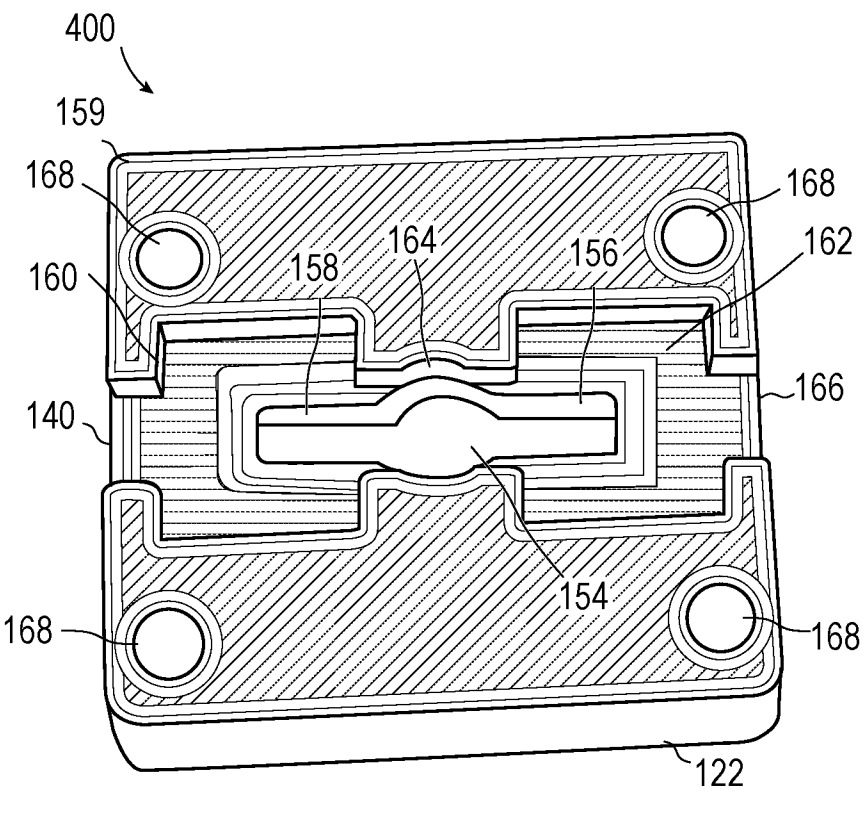
FIG. 4 is a second perspective view of the example plate.
Figure 3:
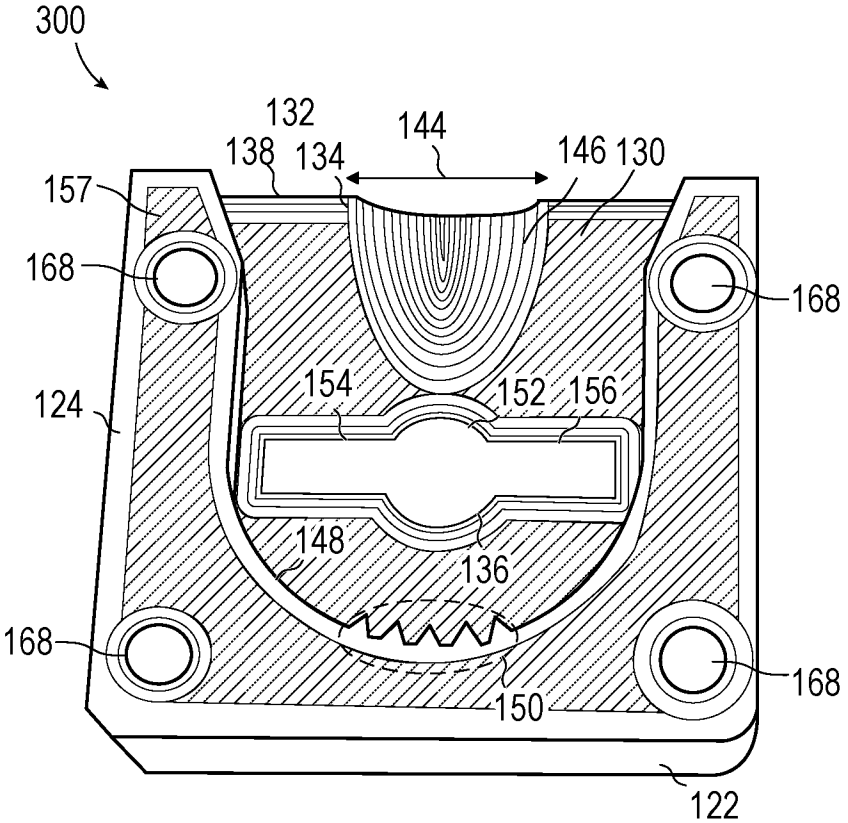
FIG. 3 is a first perspective view of an example plate.

FIGS. 3-4 are first and second perspective views 300 and 400 of the base plate 122, as shown in FIGS. 1-2. Thus, reference can be made to example of FIGS. 1-2 in the example of FIGS. 3-4. As shown in FIG. 3, the base plate 122 includes the grooved path 134. The grooved path 134 can have a concave shape such that a width 144 of the grooved path 134 gradually narrows as the grooved path 134 approaches the inner channel 136. The grooved path 134 includes a number of concave steps or grooves 146 that are formed along the base 138 of the canal 130. As the width of the grooved path 134 gradually narrows toward the inner channel 136 each concave step 146 can have a curvature that changes (e.g., increases) with respect to a neighboring concave step 146 toward the inner channel 136. In further examples, the canal 130 of the base plate 122 has a concave end 148 that can be opposite to an opening end of the canal (corresponding to the opening 132), as shown in FIG. 3. While the example of FIG. 3 illustrates the canal 130 as having the concave end 148 in other examples, the canal 130 have a different shape (e.g., a rectangular end). The canal 130 can have a depth so that a gear of the securing apparatus can be inserted and guided toward the inner channel 136.

The concave end 148 can include teeth 150. While the example of FIG. 3 illustrates a given number of teeth, in other examples, the concave end 148 can include a different number of teeth. By way of further example, the inner channel 136 includes a circular portion 152 and rectangular openings 154 and 156 that are formed in the base 138 of the base plate 122. Complementary circular and rectangular openings are also formed on a side 159 of the base plate 122 opposite a side 157 on which the circular and rectangular portions 152, 154, and 156 are formed. Additionally, the side 159 of the base plate 122 include respective cavities 160 and 162, and a cavity coupling channel 164 for connecting the cavities 160 and 162. The cavity 160 includes the side opening 140. The sliding pusher 142 can be extended toward the circular portion 152 through the cavity 160 into the cavity coupling channel 164. In some examples, the cavity 162 includes a side opening 166, and the sliding pusher 142 can be extended toward the circular portion 152 through the cavity 162 into the cavity coupling channel 164. Through which of the side openings 140 or 166 that the sliding pusher 142 can be extended can be based on which side of the user the mounting apparatus 102 is worn. As shown in FIGS. 3-4, the base plate 122 is a given width and thus include channels 168 that can extend through the base plate 122 to form respective openings on the sides 157 and 159 of the base plate 122.

Figure 5:
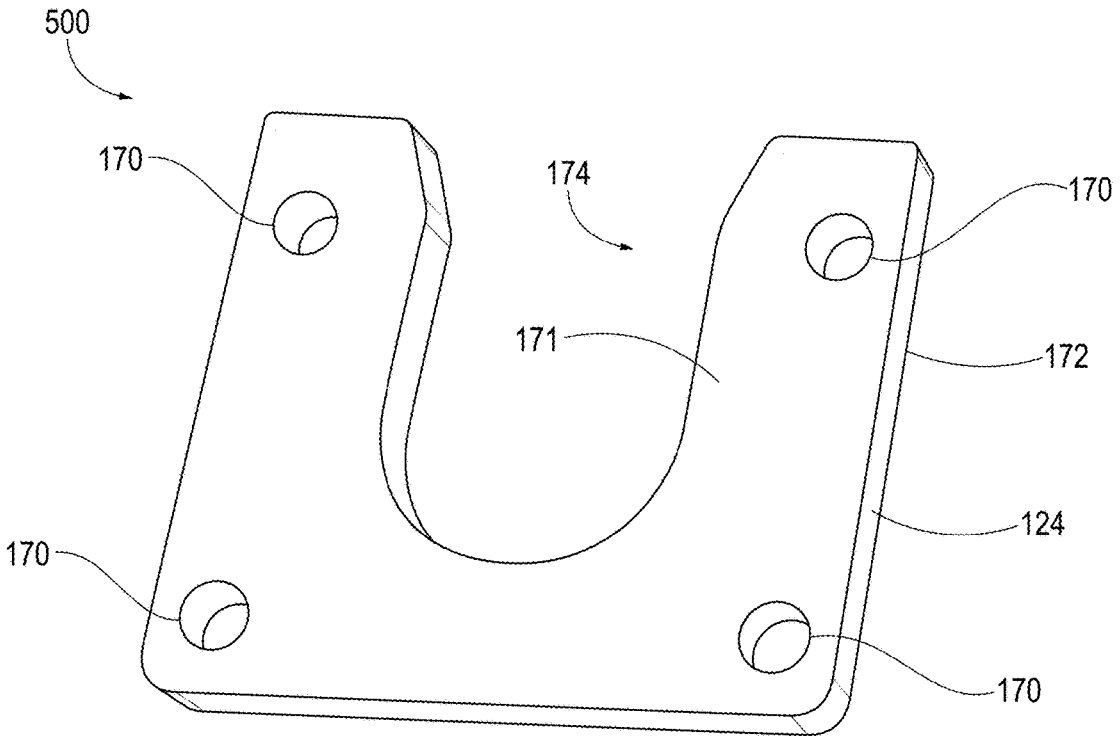
FIG. 5 is a perspective view of an example plate cover.

FIG. 5 is a perspective view of the base plate cover 124, as shown in FIG. 1. Thus, reference can be made to example of FIGS. 1-4 in the example of FIG. 5. As shown in FIG. 5, the base plate cover 124 is of a given width and include channels 170 that extend through the base plate cover 124 to form respective openings on sides 171 and 172 of the base plate cover 124. In some examples, the channels 168 and 170 can define or form the channel 128, as shown in FIG. 1. The base plate cover 124 can include an opening 174 for allowing the gear of the securing apparatus to be inserted and guided toward the inner channel 136. Once the respective openings of the base plate 122 are aligned with the respective openings of the base plate cover 124, the base plate 122 and the base plate cover 124 can be secured (e.g., via fasteners, or some different securing mechanism).

Figure 6:
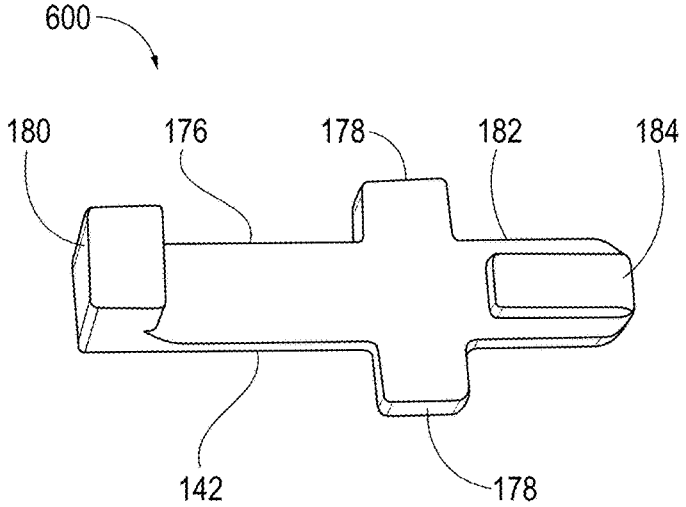
FIG. 6 is a perspective view of an example slide pusher.

FIG. 6 is a perspective view of the slide pusher 142, as shown in FIG. 1. Thus, reference can be made to example of FIGS. 1-5 in the example of FIG. 6. The slide pusher 142 includes a body 176, wings 178 that extend from the body 176, a tail end 180, and a head end 182. The wings 178 of the slide pusher 142 can be positioned within one of the cavities 160 and 162 so that the tail end 180 of the slide pusher 142 extends away from the corresponding cavity 160 and 162 and through one of the side openings 140 and 166. The wings 178 can be used to retain the slide pusher 142 within one of the cavities 160 and 162. Once positioned, the head end 182 of the slide pusher 142 can extend into the cavity coupling channel 164. The head end 182 of the slide pusher 142 can include a sloped portion 184 to enable manual release or disengagement of the sleeve from the mounting apparatus 102, as described herein.

Figure 7:
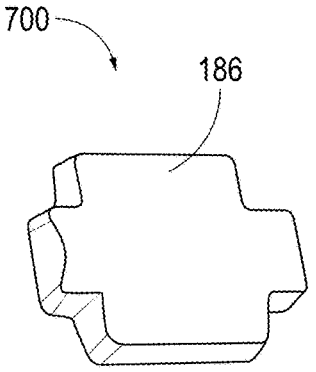
FIG. 7 is a perspective view of an example block insert.

FIG. 7 is a perspective view 700 of a block insert 186 that can be used in the mounting apparatus 102, as shown in FIG. 1. Thus, reference can be made to example of FIGS. 1-6 in the example of FIG. 7. The block insert 186 can be inserted into a respective one of the cavities 160 and 162, as shown in FIG. 2. For example, if the wings 178 of the slide pusher 142 are positioned within the cavity 160, the block insert 186 can be positioned within the cavity 162. The block insert 186 can be used to stop the slide pusher 142 such as during manual release or disengagement.

Figure 8:
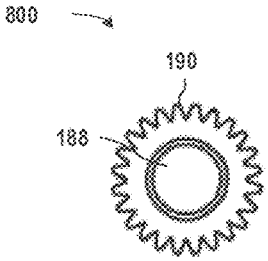
FIG. 8 is a first perspective view of an example gear.
Figure 9:
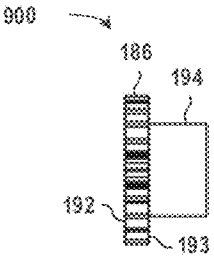
FIG. 9 is a second perspective view of the example gear.

FIGS. 8-9 are first and second perspective view of a gear 188 that can be used for securing the sleeve to the mounting apparatus 102, as shown in FIG. 1. Thus, reference can be made to example of FIGS. 1-7 in the example of FIGS. 8-9. The gear 188 includes a number of teeth 190 that protrude axially and circumferentially from a center of the gear 188. The gear 188 can have a first face 192 and a second face 193. A tube body 194 can extend away from the second face 193 of the gear 188 and be of sufficient length to support a plunger device, such as described herein.

Figure 10:
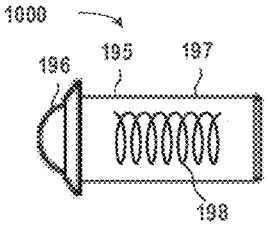
FIG. 10 is a first perspective view of an example plunger.
Figure 11:
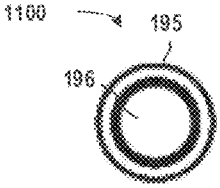
FIG. 11 is a second perspective view of the example plunger.

FIGS. 10-11 are first and second perspective views 1000 and 1100 of a plunger device 195 that can be used during securing of the sleeve to the mounting apparatus 102, as shown in FIG. 1. Thus, reference can be made to example of FIGS. 1-9 in the example of FIGS. 10-11. The plunger device 195 can include a plunger 196 and a plunger body 197. The plunger device 195 can be positioned at least partially through the gear 188 so that the plunger 196 extends away from the first face 192 of the gear 188. The plunger body 197 can extend at least partially through the tube body 194. The plunger body 197 includes a spring 198 that can be compressed during securing of the sleeve to the mounting apparatus 102. The spring 198 can be coupled to the plunger 196. The spring 198 can keep a constant pressure on the plunger 196 when the plunger 196 is in a resting position. In some examples, a force can be applied on the plunger 196, such as during the securing of the sleeve to the mounting apparatus 102, and the plunger 196 can be extended. The plunger 196 can be pushed back into the plunger body 197 when the force on the plunger 196 exceeds a spring force being applied by the spring 198.

Figure 12:
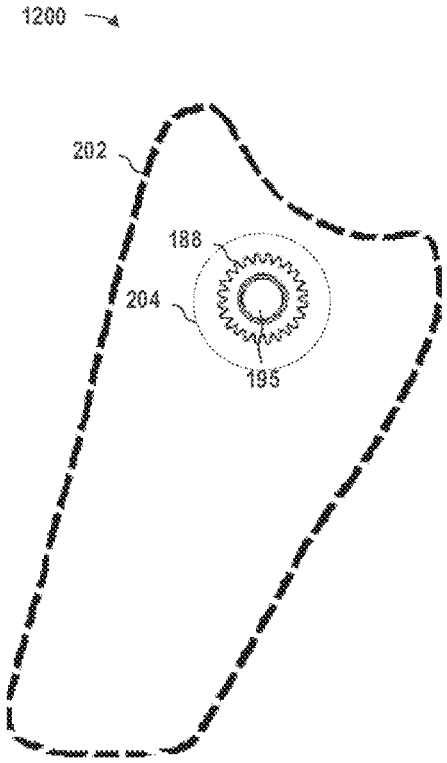
FIG. 12 is a perspective view of an example tool sleeve.

FIG. 12 is a perspective view 1200 of an example sleeve 202 with a securing apparatus 204. The securing apparatus 204 includes the gear 188 and the plunger device 195 positioned therein. The plunger 196 of the plunger device 195 can protrude from the gear 188. Thus, reference can be made to the examples of FIGS. 1-11 in the example of FIG. 12. The sleeve 202 can be used to retain or hold a tool, for example, a firearm. For example, to secure the sleeve 202 to the mounting apparatus 102, the sleeve 202 is positioned with respect to the mounting apparatus 102 so that the securing apparatus 204 is moved toward the opening 132 of the canal 130 of the base plate 122. As the plunger 196 of the securing apparatus 200 enters the opening 132, the plunger 196 can engage the grooved path 134 of the base 138 of the base plate 122. The grooved path 134 allows for the plunger 196 to clear the canal 130 toward the inner channel 136 as the sleeve 202 is pushed toward (e.g., downward) the inner channel 136. Each concave step 146 gradually depresses the plunger 196 inward (e.g., into the plunger body 197) as the plunger 196 is being pushed toward the inner channel 136. Once the plunger 196 reaches a final or last concave step 146, the plunger 196 can become flush with an outward surface of the first face 192 of the gear 188. The plunger 196 can spring back into place through the inner channel 136 toward the side 159 of the base plate 122 in response to the plunger 196 reaching the inner channel 136 in the canal 130.

Additionally, the teeth 150 contained within the canal 130 can interlock with the teeth 190 of the gear 188, for example, once the plunger 196 reaches the inner channel 136 or springs backs into place into the inner channel 136. Because the teeth 150 and 190 are interlocked, the sleeve 202 and the mounting apparatus 102 can be connected so that the sleeve 202 does not rotate with respect to the mounting apparatus 102. In some examples, the sliding pusher 142 is omitted from the mounting apparatus 102 and the mounting apparatus 102 includes a push button. The push button can be a sliding piece underneath and above a recess that protrudes out of a top of a canal piece. To remove or disconnect the sleeve 202 from the mounting apparatus 102, a pressure (e.g., downward pressure) can be applied to the push button on the canal 130. The pressure can disengage the gear 188 from the canal 130 to move push button under the plunger 196, pushing the plunger 196 up to be flush with a floor (e.g., a surface of the base 138) of the canal 130 so that the sleeve 202 can be separated from the mounting apparatus 102. In some examples, the sliding pusher 142 can be used for manual release or disengagement of the sleeve 202 with the mounting apparatus 102. For example, a pressure can be applied to the sliding pusher 142 to move or push the wings 178 of the sliding pusher 142 along a respective cavity 160 and 162 until the sloped portion 184 of the sliding pusher 142 is moved under the plunger 196 to push the plunger 196 up to be flush with the floor of the canal 130. The sleeve 202 can be separated from the mounting apparatus 102 in response to being flush with the floor.

Figure 13:
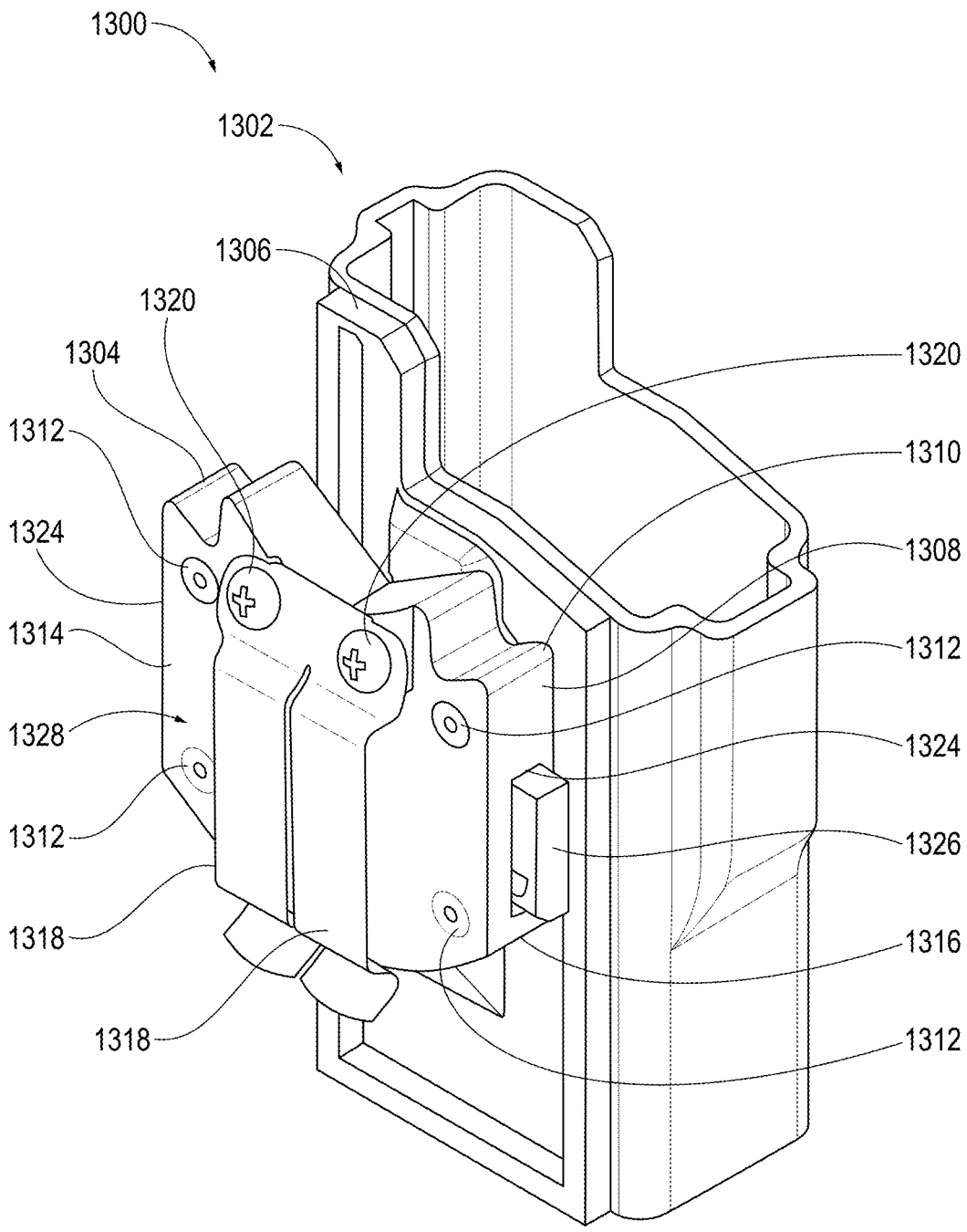
FIG. 13 is a first perspective view of an example modular holster assembly.

FIG. 13 is a perspective view 1300 of an example of a holster assembly 1302. The holster assembly 1302 includes a mounting apparatus 1304 and a holster 1306. The holster 1306 can have an ergonomic shape and support a firearm, such as a handgun (not shown). While the example of FIG. 13 illustrates the holster 1306 as supporting a handgun in other examples, the holster 1306 can be configured to support a different type of firearm. Moreover, while the example of FIG. 13 illustrates a holster for a firearm, in other examples, the holster 1306 can be designed to support a different tool (e.g., a knife, a flashlight, etc.). The mounting apparatus 1304 includes a shell 1308 and a back plate 1310. A number of channels 1312 can extend through the shell 1308 and the back plate 1310 into openings on respective sides 1314 and 1316 of one of the shell 1308 and the back plate 1310. As shown in FIG. 13, a fastener can be positioned through the channels 1312 to couple the shell 1308 and the back plate 1310. In other examples, a different mechanism can be used to secure the shell 1308 and the back plate 1310, such as described herein.

The holster assembly 1302 can further include clips 1318 that extend along a length of the side 1314. While the example of FIG. 13 illustrates two (2) clips in other examples, a single clip can be used, and positioned along a center length of the side 1314. In some examples, the mounting apparatus 1304, the holster 1306 and/or the clips 1318 are composed of different or similar materials. As an example, the materials may include flexible and/or durable materials. In additional or alternative examples the mounting apparatus 1304, the holster 1306 and/or the clips 1318 can be composed of a plastic material (e.g., a thermoplastic material) or metal material. The clips 1318 can be used to mount or secure the mounting apparatus 1304 and thus the holster 1306 to a user (e.g., via a garment, belt, strap, or accessory), or an object (e.g., a surface, furniture, vehicle, locker, etc.).

In some examples, the clips 1318 include a number of openings 1320 for use in securing the clips 1318 to the back plate 1310. In some examples, the back plate 1310 includes openings for securing the clips 1318 to the shell 1308 of the mounting apparatus 1304. For example, the openings 1320 of the clips 1318 can be aligned with one of the openings of the back plate 1310 and secured via a fastener (e.g., a screw, as shown in FIG. 13) to fix the clips 1318 with respect to the mounting apparatus 1304. In other examples, a different mechanism can be used to secure the clips 1318 to the back plate 1310, as described herein. By way of further example, the shell 1308 can further include openings 1324 through which a pinch plate 1326 can be positioned. The pinch plate 1326 can extend partially through one of the openings 1324, as shown in FIG. 13. The securing of the clips 1318 to the shell 1308 of the mounting apparatus 1304 can form a passageway(s) or loop(s) 1328. In some examples, to secure the mounting apparatus 1304 to a user, a belt of the user can be threaded along a width of the mounting apparatus 1304 through the loop(s) 1328.

Figure 14:
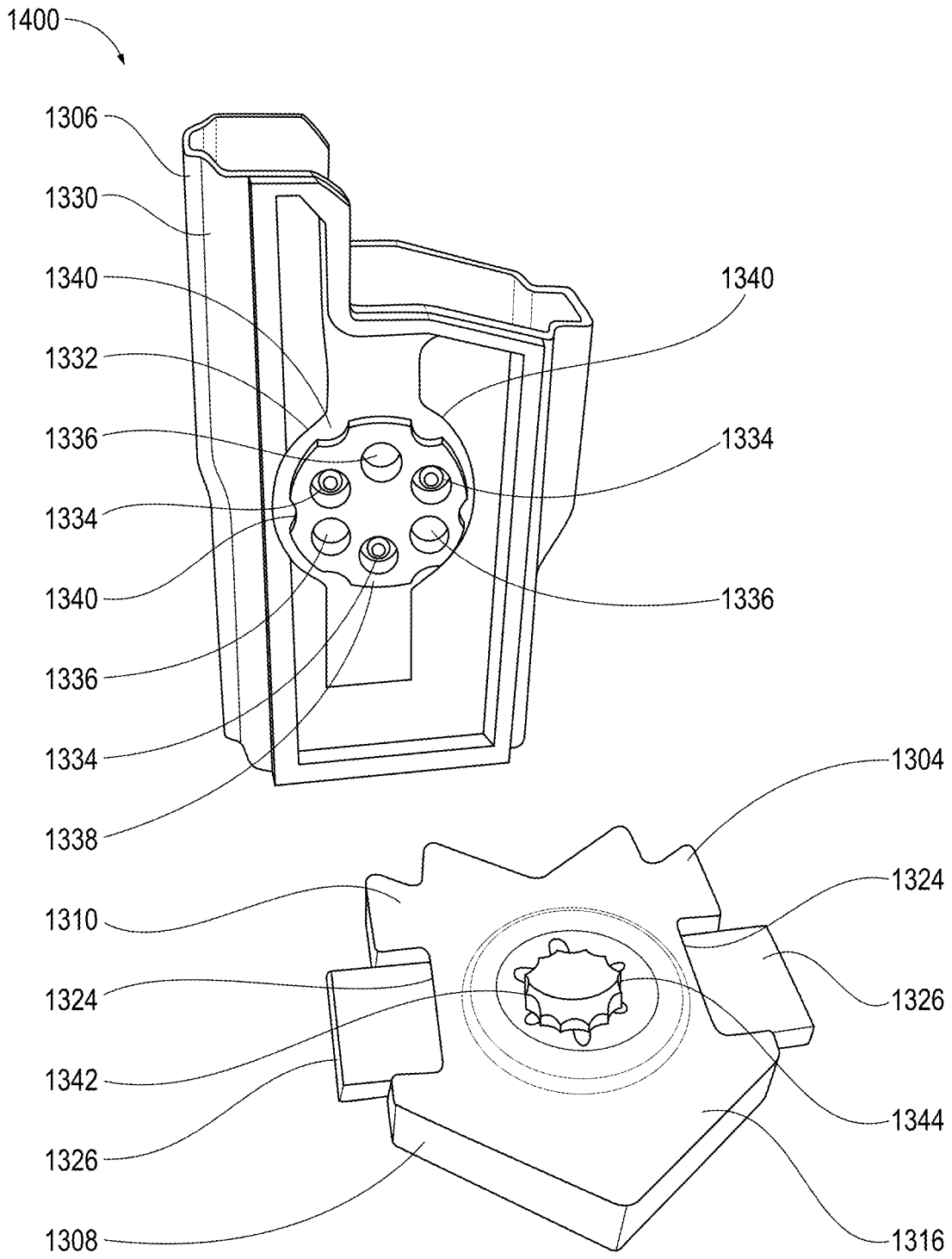
FIG. 14 is a second perspective view of the example modular holster assembly.

FIG. 14 is a perspective view 1400 of an example of the holster assembly 1302, as shown in FIG. 13. Thus, reference can be made to the example of FIG. 13 in the examples of FIG. 14. In the example of FIG. 14, the holster assembly 1302 is disassembled, such that the holster 1306 is disengaged from the mounting apparatus 1304. As shown in FIG. 14, the holster 1306 includes a surface 1330 with a ring support structure 1332 located thereon. In some examples, the holster 1306 can be molded so that the ring support structure 1332 is part of the holster 1306. The ring support structure 1332 includes a first set of channels 1334 and a second set of channels 1336. The first set of channels 1334 can be used for securing a ring attachment structure 1338 to the ring support structure 1332. As shown in FIG. 14, a respective fastener (e.g., a mating bolt) can be positioned through the channels 1334 to couple the ring attachment structure 1338 to the ring support structure 1332. In other examples, a different mechanism can be used to secure ring attachment structure 1338 to the ring support structure 1332. The ring support structure 1332 can include ribs 1340 that can protrude toward a center of the ring support structure 1332. In some examples, the ribs 1340 are curved and can have a perimeter that is similar to a semicircle. The ribs 1340 can function as guides during placement of the ring attachment structure 1338 at least partially within the ring support structure 1332. By way of further example, the mounting apparatus 1304 can include a central opening 1342 through which a gear head 1344 of a slide lock 1346 (not shown in FIG. 13) can protrude.

Figure 16:
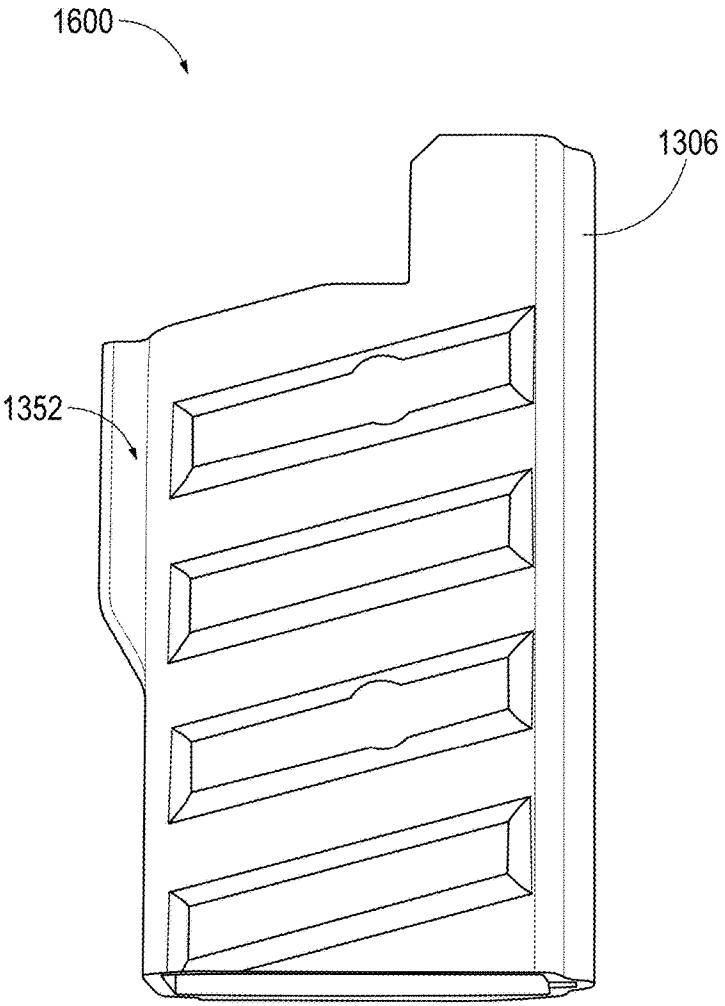
FIG. 16 is a second perspective view of the example holster.
Figure 15:
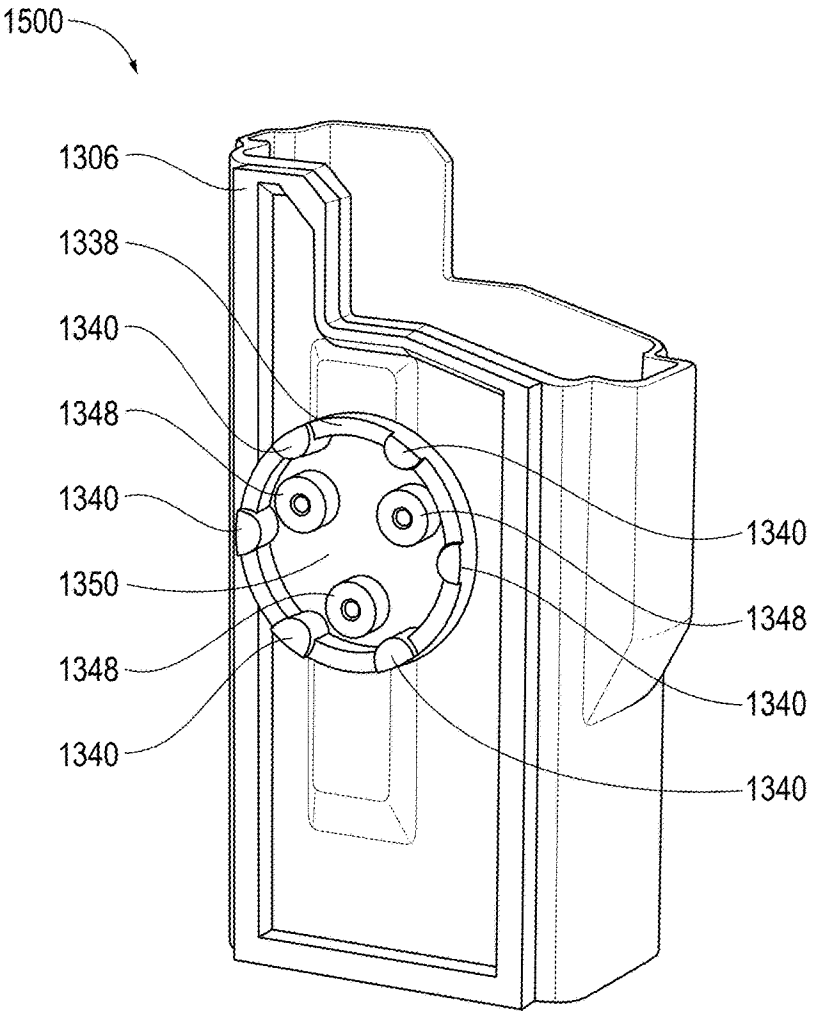
FIG. 15 is a first perspective view of an example holster.

FIGS. 15-16 are first and second perspective view of the holster 1306, as show in FIGS. 13-14. Thus, reference can be made to the examples of FIGS. 13-14 in the examples of FIGS. 15-16. In some examples, disposed within the ring support structure 1332 are a number of securing portions 1348. In some examples, the securing portions 1348 are fasteners that resemble a nut and thus can be threaded with the mating bolt. During securing of the ring attachment structure 1338 to the ring support structure 1332, the ring attachment structure 1338 can be aligned with respect to the ring support structure 1332 so that each channel of the first set of channels 1334 is aligned with one of the securing portions 1348. The ring support structure 1332 can have a greater circumference than the ring attachment structure 1338. Thus, the ring attachment structure 1338 can at least be partially positioned within a cavity 1350 of the ring support structure 1332. Once the ring attachment structure 1338 is partially located within the cavity 1350, the respective fastener can be positioned through each of the first set of channels 1334 and mated with one of the securing portions 1348. In some examples, the holster 1306 can include ergonomic grooves 1352 to provide a ribbed texture for increasing a use of the holster 1306 on an opposite side of the ring support structure 1332.

Figure 17:
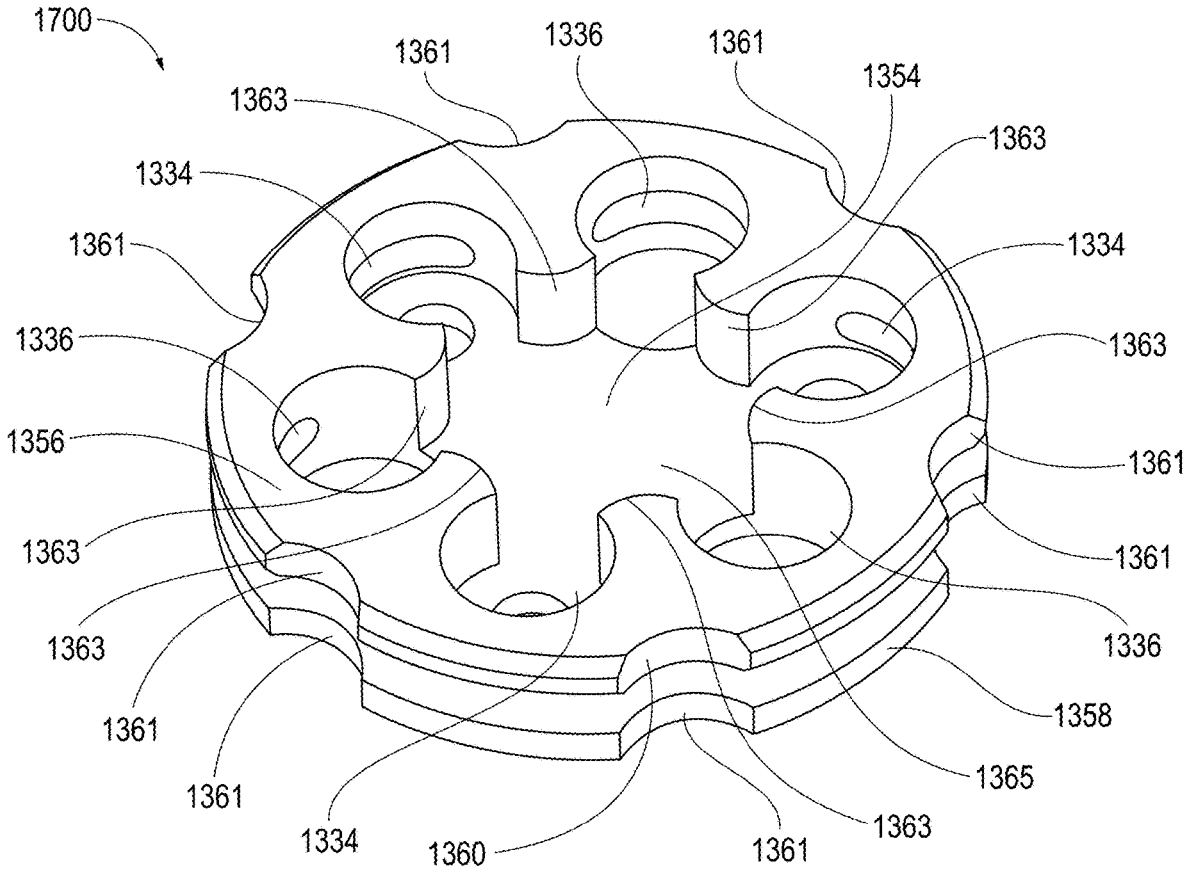
FIG. 17 is a first perspective view of an example ring attachment structure.
Figure 18:
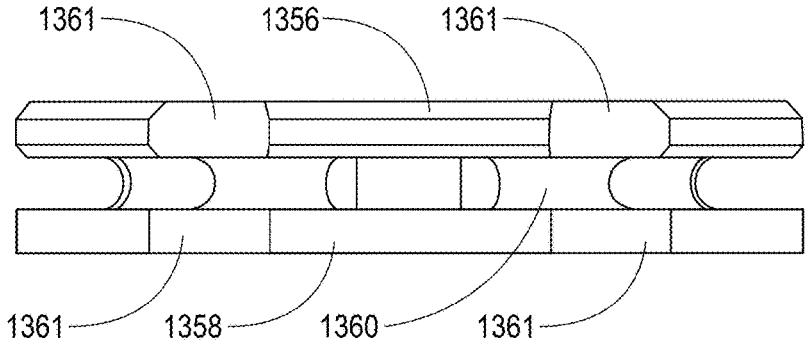
FIG. 18 is a second perspective view of the example ring attachment structure.

FIGS. 17-18 are first and second perspective views of the ring attachment structure 1338, as shown in FIG. 14. Thus, reference can be made to the examples of FIGS. 13-16 in the examples of FIGS. 17-18. The ring attachment structure 1338 includes a base 1354. The first and second channels 1334 and 1336 can open into the base 1354. In some examples, the ring attachment structure 1338 includes first and second circular portions 1356 and 1358. The first and second circular portions 1356 and 1358 can be coupled via a coupling portion 1360. Each of the first and second circular portions 1356 and 1358 can include indents 1361. During securing of the ring attachment structure 1338 to the ring support structure 1332, the indents 1361 can be configured to receive one of the ribs 1340. Thus, the ribs 1340 can be retained with one of the indents 1361 to prevent rotational motion of the ring attachment structure 1338 about its axis. By way of further example, the coupling portion 1360 includes retention portions 1363. The retention portions 1363 can be used to retain the gear head 1344. For example, the gear head 1344 can be extended into a cavity 1365 toward the base 1354 to come into contact with the retention portions 1363. The retention portions 1363 can be used for fixing the gear head 1344 to the mounting apparatus 1304 to the holster 1306.

Figure 19:
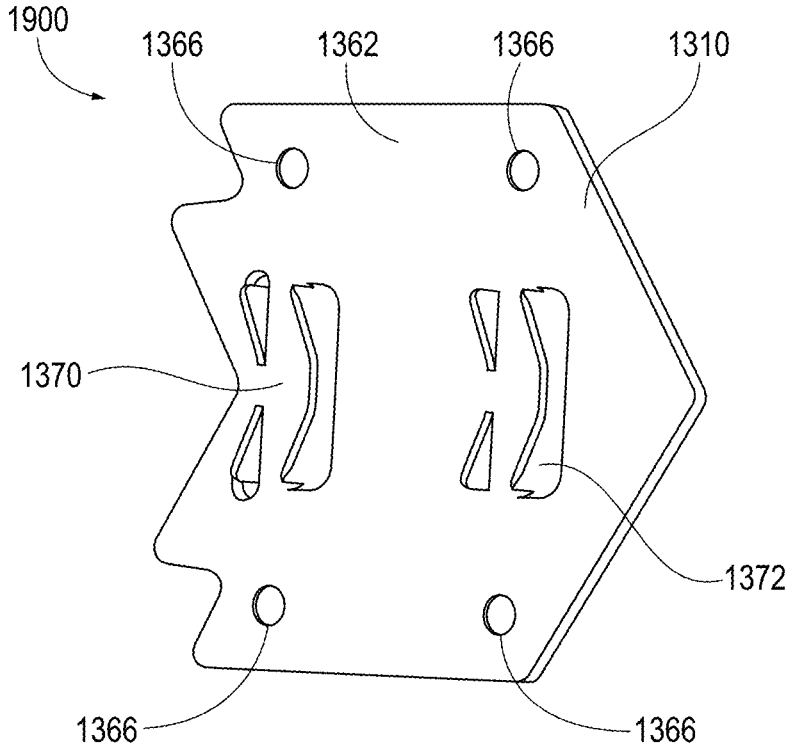
FIG. 19 is a first perspective view of an example back plate.
Figure 20:
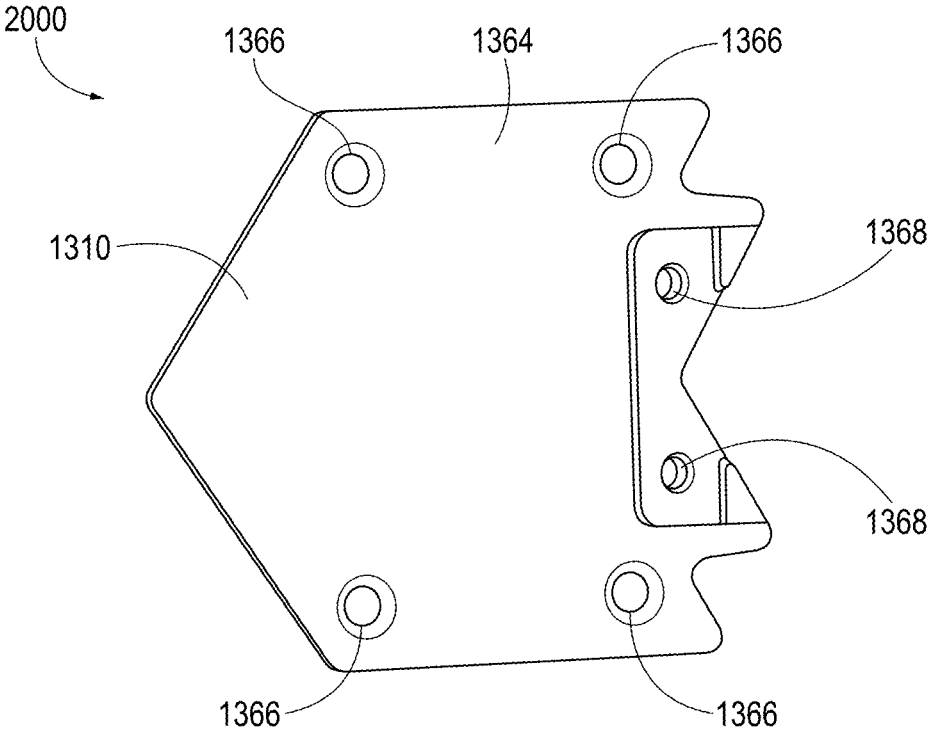
FIG. 20 is a second perspective view of the example back plate.

FIGS. 19-20 are first and second perspective views 1900 and 2000 of back plate 1310, as shown in FIGS. 13-14. Thus, reference can be made to the examples of FIGS. 13-18 in the examples of FIGS. 19-20. The back plate 1310 has sides 1362 and 1364. In some examples, the side 1364 can correspond to the side 1314, as shown in FIGS. 13-14. The back plate 1310 includes first openings 1366 and a second openings 1368. During assembly of the mounting apparatus 1304, the shell 1308 can be coupled to the back plate 1310 such that the first openings 1366 of the back plate 1310 are aligned with openings of the shell 1308. Thus, the channel 1312 can extend through the shell 1308 and the back plate 1310 into corresponding first openings of the shell 1308 and the back plate 1310. During assembly of the mounting apparatus 1304 and the clips 1318, the clips 1318 can be coupled to the back plate 1310 such that the second openings 1368 are aligned with the openings 1320 of the clips 1318. By way of further example, the back plate 1310 includes plate interlocking structures 1370 and 1372. The plate interlocking structures 1370 and 1372 can be configured to engage corresponding shell interlocking structures 1374 and 1376 of the shell 1308 that can protrude in a cavity 1383 of the shell 1308, as shown in FIG. 21

Figure 21:
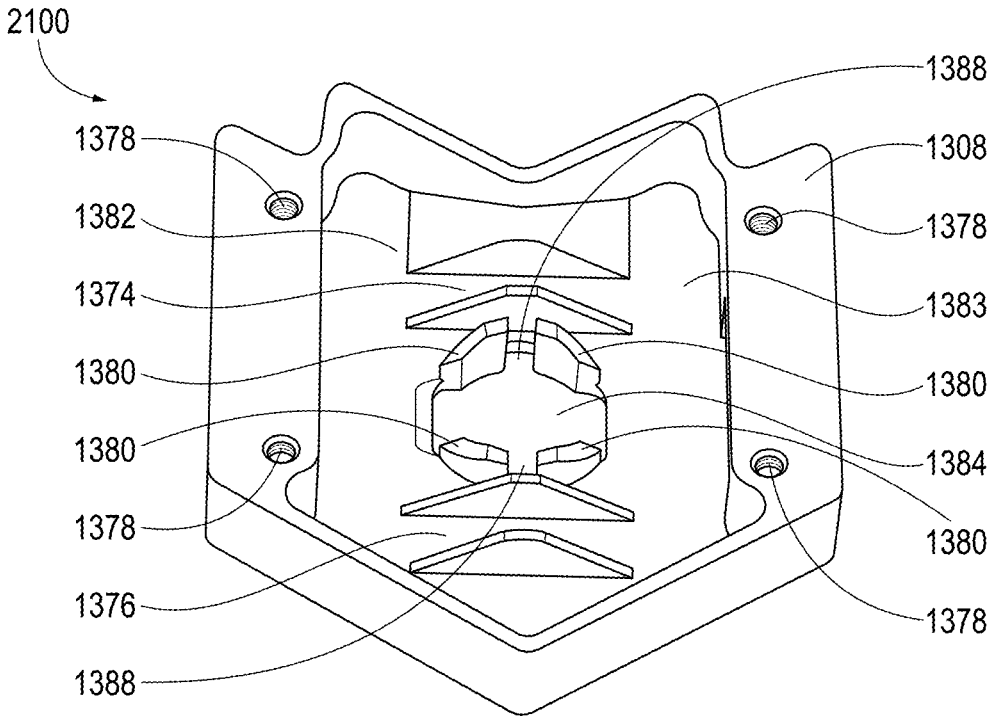
FIG. 21 is a first perspective view of an example shell.
Figure 22:
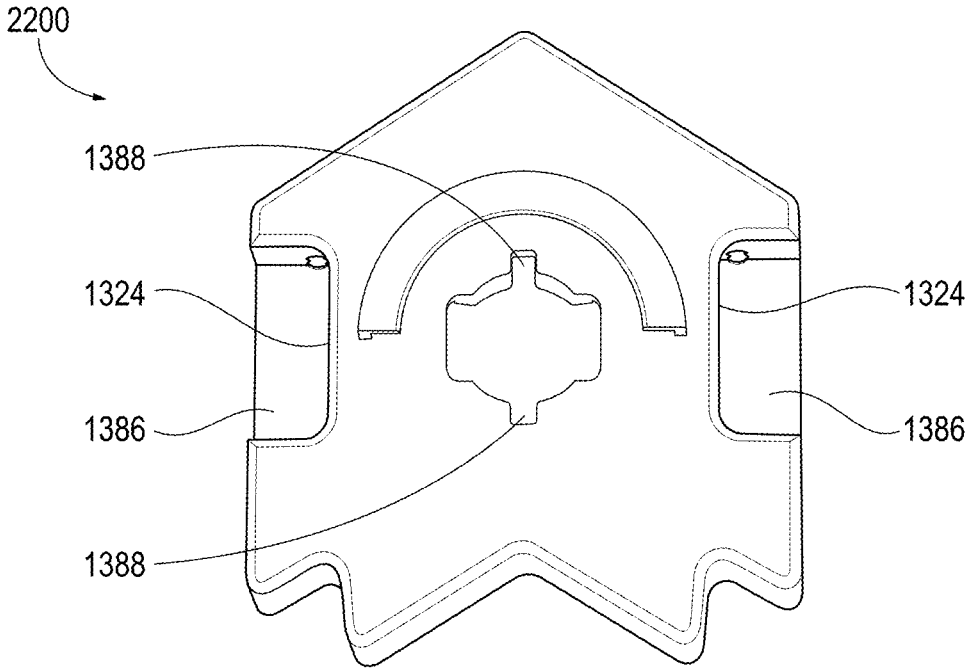
FIG. 22 is a second perspective view of the example shell.

FIGS. 21-22 are first and second perspective views 2100 and 2200 of shell 1308, as shown in FIGS. 13-14. Thus, reference can be made to the examples of FIGS. 13-20 in the examples of FIGS. 21-22. The shell 1308 includes channels 1378 that can be aligned with one of the first openings 1366 during assembly of the mounting apparatus 1304. The shell 1308 can further include lips 1380 that can protrude from a base 1382 of the shell 1308 and thus an opening 1384 of the shell 1308. In some examples, the opening 1384 can correspond to the central opening 1342, as shown in FIG. 14. The lips 1380 can be used to retain the gear head 1344 of the slide lock 1346, as shown in FIG. 14, for example, during assembly of the mounting apparatus 102. By way of further example, the shell 1308 includes recesses 1386. The openings 1324 of the shell 1308 can open into recesses 1386. A respective recess 1386 can be used to retain a respective leg 1390 of the slide lock 1346, as shown in FIG. 22, during assembly of the mounting apparatus 1304. In further examples, the opening 1384 of the shell 1308 can include notches 1388. The notches 1388 can receive a respective lip 1392 of the slide lock 1346, as shown in FIG. 22, during assembly of the mounting apparatus 1304.

Figure 23:
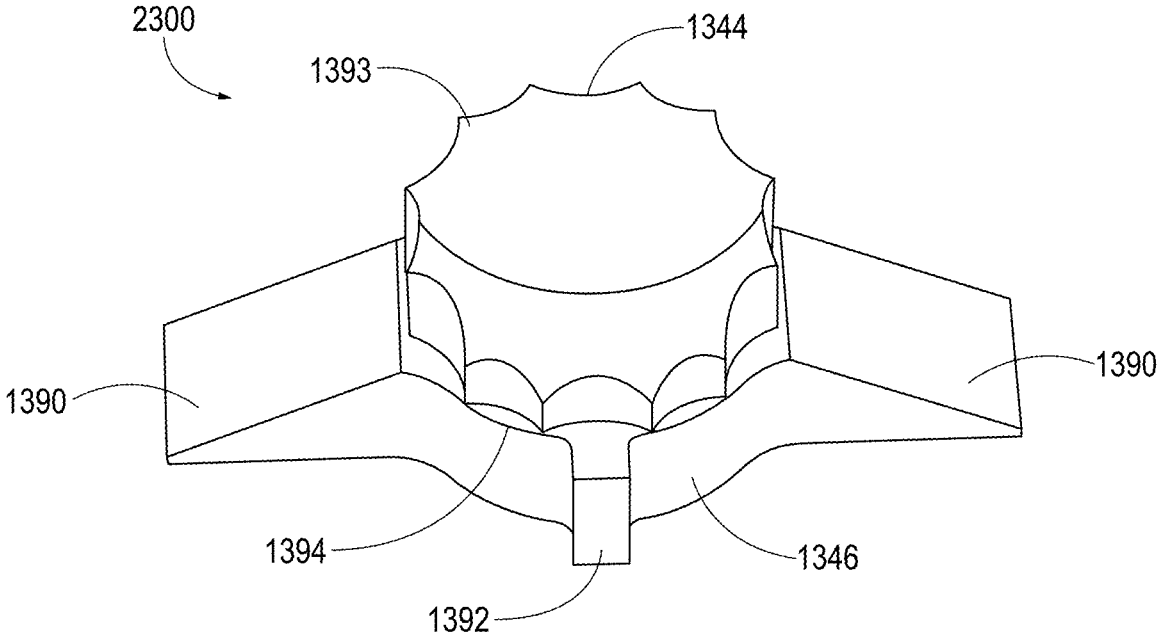
FIG. 23 is a first perspective view of an example slide lock.
Figure 24:
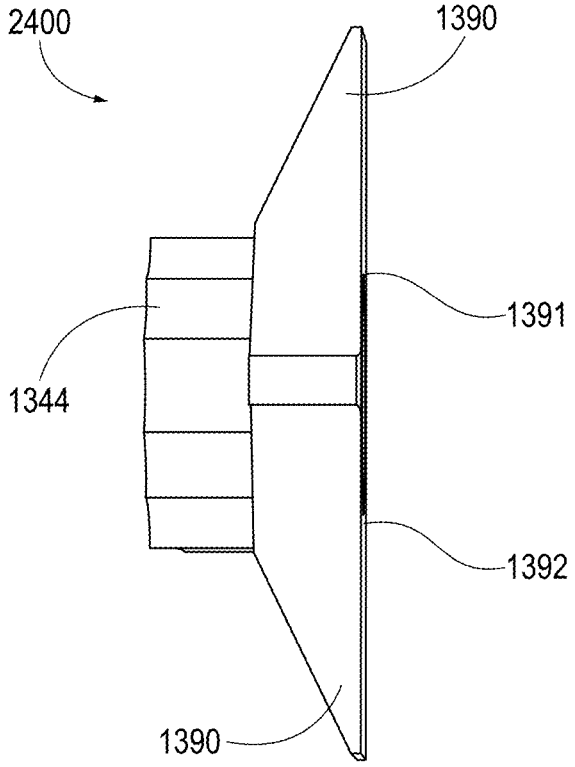
FIG. 24 is a second perspective view of the example slide lock.

FIGS. 23-24 are first and second perspective views 2300 and 2000 of the slide lock 1346, as shown in FIGS. 13-14. Thus, reference can be made to the examples of FIGS. 13-22 in the examples of FIGS. 22-23. The slide lock 1346 can include a base 1394 on which the gear head 1344 can be situated. The legs 1390 of the slide lock 1346 can extend away from the base 1394 in opposite directions, as shown in FIGS. 22-23. In some examples, the gear head 1344 includes a number of ribs 1393 that form an outer portion (e.g., an outer shell) of the gear head 1344, such that the gear head 1344 resembles a gear. During assembly of the mounting apparatus 1304, the slide lock 1346 can be positioned within the cavity 1383 so that a bottom face 1391 lays on a surface of the base 1382 of the shell 1308. The legs 1390 of the slide lock 1346 can extend toward one of the openings 1324 of the shell 1308. The legs 1390 can extend into a cavity 1396 of a corresponding pinch plate 1326, such as shown in FIG. 24

Figure 25:
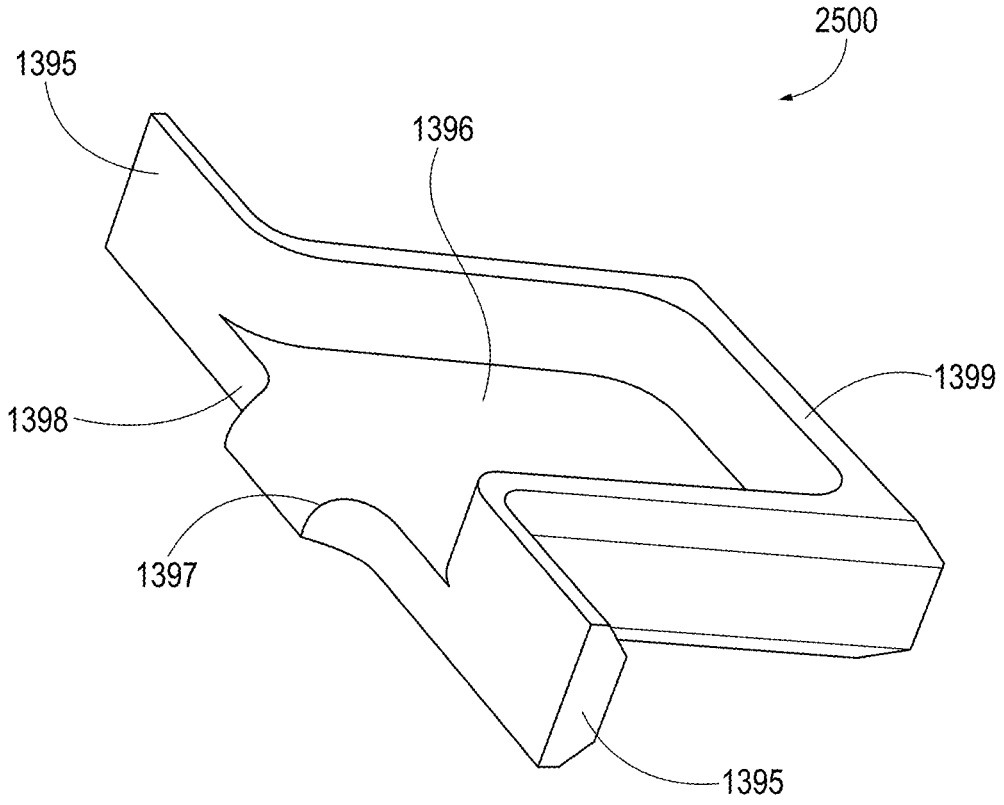
FIG. 25 is a perspective view of an example pinch plate.

FIG. 25 is a perspective view 2500 of one of the respective pinch plates 1326, as shown in FIGS. 13-14. Thus, reference can be made to the examples of FIGS. 13-24 in the example of FIG. 25. The pinch plate 1326 includes side protruding flanges 1395 that extend away from a body of the pinch plate 1326. The pinch plate 1326 further includes the cavity 1396 and a forward facing flange 1397 that extends away from a face portion 1398 of the pinch plate 1326. During assembly of the mounting apparatus 1304, the side protruding flanges 1395 are positioned within the cavity 1383 of the shell 1308 such that a rear portion 1399 of the pinch plate 1326 can extend into the recess 1386. The side protruding flanges 1395 can move within the cavity 1383

(e.g., in response to a pressure) so that the forward facing flange 1397 can engage one of the legs 1390 of the slide lock 1346.

For example, to secure the holster 1306 to the mounting apparatus 1304, the holster 1306 can be moved toward the mounting apparatus 102 so that the ring attachment structure 1338 (secured to the ring support structure 1332) is aligned to receive the gear head 1344 of the mounting apparatus 102. The gear head 1344 can be oriented toward the surface of the base 1354. As the gear head 1344 enters the cavity 1365 of the ring attachment structure 1338, the gear head 1344 engages (e.g., slides against) the retention portions 1363 and the retention portions 1363 create a force to secure the gear head 1344 therein and thus secure the mounting apparatus to the holster 1306. In some examples, the forward facing flange 1397 of each pinch plate 1326 can be adjacent to the opening 1384 (e.g., located underneath). The gear head 1344 can push the forward facing flanges 1397 away from the opening 1384 as the gear head 1344 is pushed toward the base 1354. Radial movement of the holster 1306 can be minimized or prevented because at least some of the ribs 1393 of the gear head 1344 are located between neighboring retention portions of the retention portions 1363.

To disengage the holster 1306 from the mounting apparatus 1304, a force (e.g., pressure, or pulling force) can be applied by the user to the holster 1306 to overcome the force that is securing the gear head 1344 in the cavity 1365 and thus separate the holster 1306 from the mounting apparatus 1304. For example, the user can apply a respective force to each pinch plate 1326 to move the pinch plate 1326 inward toward the central opening 1342. The forward facing flange 1397 of each pinch plate 1326 can slide under the gear head 1344 to push the gear head 1344 away from the base 1354 of the ring attachment structure 1338. This can overcome the force that was securing the gear head 1344 within the cavity 1365 to free the holster 1306 from the mounting apparatus 1304.

As used herein, the term "coupled" or "coupled to" or "connected" or "connected to" or "attached" or "attached to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification.

It is to be further understood that like or similar numerals in the drawings represent like or similar elements through the several figures, and that not all components or steps described and illustrated with reference to the figures are required for all embodiments or arrangements.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third) is for distinction and not counting. For example, the use of "third" does not imply there is a corresponding "first" or "second." Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims.

The invention claimed is:

1. A holster system comprising:

a clip;

a holster for supporting a tool, the holster comprising a ring support structure having a cavity comprising a ring attachment structure, the ring attachment structure comprising retention portions for engaging a gear head of a slide lock; and a mounting apparatus comprising a cavity that includes the slide lock, and an opening through which the gear head of the slide lock protrudes, the mounting apparatus further comprising openings through which portions of pinch plates can extend for disengaging the holster from the mounting apparatus.

2. The holster system of claim 1, wherein each pinch plate comprises a cavity, and the slide lock includes legs on opposite sides, wherein the cavity of each pinch plate receives a respective leg of the legs of the slide lock.

3. The holster system of claim 2, wherein each pinch plate comprises a forward facing flange for sliding under the gear head to push the gear head away from a base of the ring attachment structure in response to the pinch plates being engaged.

4. The holster system of claim 3, wherein the gear head comprises ribs, and at least some of the ribs are located between neighboring retention portions of the retention portions to prevent a rotation of the holster with respect to the mounting apparatus.

5. The holster system of claim 4, wherein the opening comprises notches and the slide lock comprises lips, the lips being located within a respective notch of the notches to prevent a rotation of the slide lock.

* * * * *